US005323924A

United States Patent [19]

Wolff

[11] Patent Number: 5,323,924

[45] Date of Patent: Jun. 28, 1994

[54] CASE FOR COSMETICS, JEWELRY, AND THE LIKE

[75] Inventor: Stacy L. Wolff, Akron, Ohio

[73] Assignee: Rubbermaid Incorporated, Wooster, Ohio

[21] Appl. No.: 2,184

[22] Filed: Jan. 8, 1993

[51] Int. Cl.[5] ..... B65D 25/10

[52] U.S. Cl. ..... 220/410; 206/566; 206/581; 220/324; 220/408

[58] Field of Search ..... 206/44 R, 45.14, 45.19, 206/315.11, 370, 372, 373, 503, 508, 509, 581, 823, 379, 566, 6.1; 220/23.83, 23.86, 212, 521, 522, 324, 410, 408

[56] References Cited

U.S. PATENT DOCUMENTS

| | | | |
|---|---|---|---|
| D. 144,278 | 3/1946 | Wohl | D85/2 |
| D. 144,743 | 5/1946 | Sussman | D58/12 |
| D. 175,537 | 9/1955 | Combridge | D57/1 |
| D. 182,654 | 4/1958 | Glaberson | D80/5 |
| 1,513,776 | 11/1924 | Wells . | |
| 2,219,597 | 10/1940 | Lutz | 206/12 |
| 3,181,726 | 5/1965 | Parker | 220/324 |
| 3,578,153 | 5/1971 | Olson | 205/379 |
| 4,085,987 | 4/1978 | Vartdal | 206/315.11 |
| 4,503,972 | 3/1985 | Nelligan et al. | 206/379 |
| 4,660,719 | 4/1987 | Peterson et al. | 206/45.23 |
| 4,717,024 | 1/1988 | Djezovic | 206/581 |

OTHER PUBLICATIONS 2 catalog pages, Jammers ®, a Division of Plano Molding Company, 431 E. South St., Plano, Ill., 60545-1601; 1992.

16 catalog pages, Caboodles, a Division of Plano Molding Company, 431 E. South St., Plano, Ill., 60545-1601; 1992.

1 page, Sassaby, Sassaby Ltd., Del Mar, Calif., 92014; 1991.

*Primary Examiner*—Jimmy G. Foster

*Attorney, Agent, or Firm*—Renner, Kenner, Grieve, Bobak, Taylor & Weber

[57] ABSTRACT

A container (10) for holding items such as cosmetics, jewelry and the like includes a base portion (12) and a cover portion (11) attached thereto. Within the container (10) is a removable tray (51) which includes a basket portion (52) carried by a surrounding support wall (58). The base (12) of the container (10) supports and holds the tray (51) on a plurality of ribs (77) disposed inwardly on the upturned arcuate side surfaces (33, 34) of the base (12). When the container (10) is open, the tray (51) may be removed and selectively positioned outside the container (10). In addition, the tray (51) may be selectively positioned on the cover (11) which includes similar ribs (80) to those found in the base (12). The tray (51) also includes a mirror assembly (67) which is hingedly attached thereto and may be used as a lid for the basket (52) of the tray (51).

17 Claims, 5 Drawing Sheets

CASE FOR COSMETICS, JEWELRY, AND THE LIKE

TECHNICAL FIELD

This invention relates to a case or container for holding items such as cosmetics, jewelry and the like. More specifically, this invention relates to such a container which includes a tray which may be selectively positioned in the base or cover of the container or separately from the container, as desired by the user, and which includes a pivotal mirror to assist the user in applying cosmetic or jewelry items.

BACKGROUND ART

Cases or containers for holding items such as cosmetics, jewelry and the like have long been known in the art. However, few, if any, such cases have trays which may be removed therefrom. Nevertheless, it is often desirable to include a tray in such a case for organizational purposes as well as for instances where heavier items may crush lighter items if they are not separated.

Furthermore, mirrors are often included in such cases or containers. However, the mirror is usually permanently attached to some part of the case or completely separated therefrom such that it is necessary for the user either hold the mirror or find some object to accommodate the mirror and hold it in an upright position during use. In addition, in instances where the mirror is attached to the case or container, such detracts from the possibility of using that space for other purposes, as may often be desired. Accordingly, it is desirable to provide the case with more than one means for holding the mirror such that the mirror can be selectively positioned where desired by the user. This same characteristic is often desired by the user for the tray as well.

Thus, the need exists for a case for holding cosmetics, jewelry, or the like which has a removable tray selectively positionable in the base or cover of the case or separately therefrom, as desired by the user, and which includes a pivotal mirror attached to the tray.

DISCLOSURE OF THE INVENTION

It is therefore the primary object of the present invention to provide a container for holding items such as cosmetics, jewelry or the like.

It is another object of the present invention to provide a container, as above, which includes a selectively positionable tray, the tray being positionable in the base of the container, the cover of the container, or separately from the container.

It is a further object of the present invention to provide a container, as above, which includes a mirror hingedly attached to the tray, the mirror also conveniently constituting the lid for the tray when the mirror is in its closed position.

It is still another object of the present invention to provide a container, as above, which includes a hinge mechanism for hingedly attaching the cover to the base.

It is yet another object of the present invention to provide a container, as above, which includes a latch mechanism for selectively securing the cover to the base.

It is a still further object of the present invention to provide a container, as above, which includes a pivotable handle on the top of the cover and a recess in the base for stacking a plurality of containers.

These and other objects of the present invention, as well as the advantages thereof over existing prior art forms, which will become apparent from the description to follow, are accomplished by the means hereinafter described and claimed.

In general, a container for holding items such as cosmetics, jewelry, and the like includes a base portion and a cover portion. The cover portion is hingedly attached to the base portion at one end and selectively attached to the base portion at the opposite end. A tray is selectively positionable in the container and is selectively supported by rib members extending inwardly from the base portion, or by rib members extending inwardly from the cover portion which can thereby hold the tray when the container is open.

The present invention also provides, in combination, a container and a tray for holding items such as cosmetics, jewelry and the like. The container includes a base portion and a cover portion operatively attached thereto. The tray is selectively positionable in the container. The container includes rib members in the base portion for receiving and supporting the tray, and rib members in the cover portion for also receiving and supporting the tray.

A preferred exemplary container incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
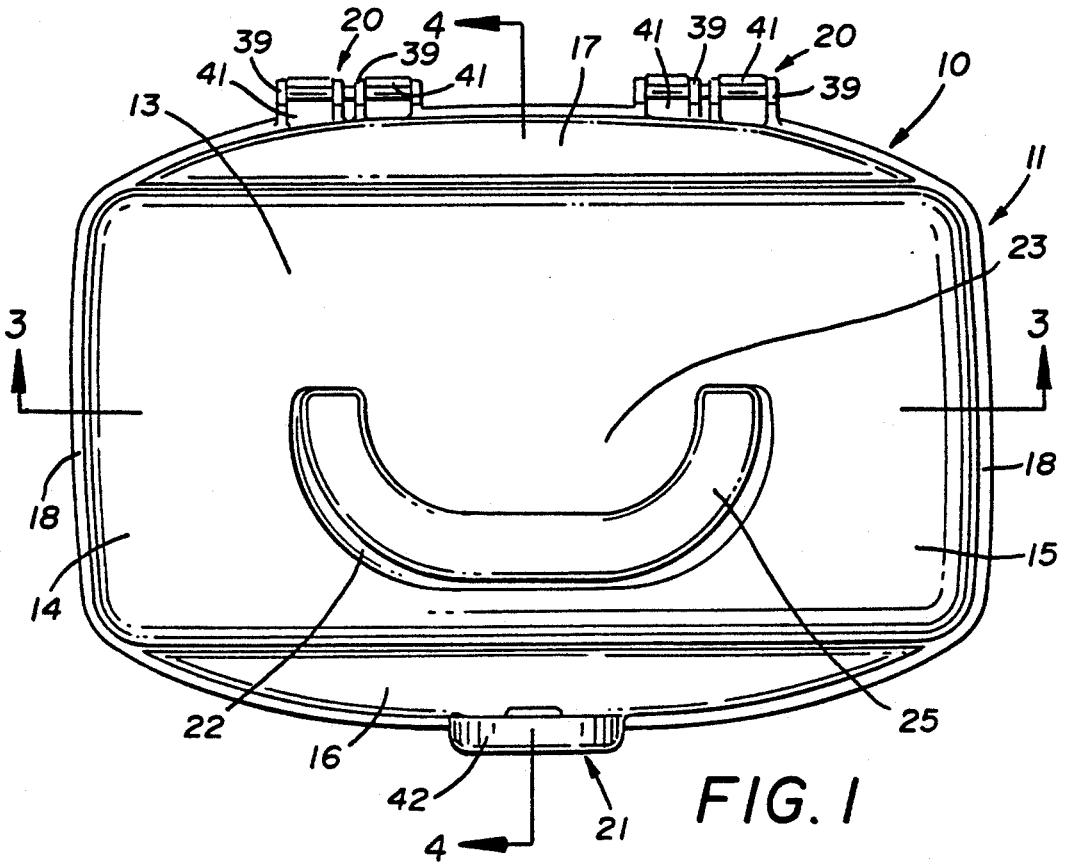
FIG. 1 is a top plan view of the cosmetic or jewelry container made in accordance with the concepts of the present invention.

A container for storing cosmetics, jewelry and like items is indicated generally by the numeral 10 in the drawings. Container 10 is preferably molded of a polypropylene material and includes a cover portion generally indicated by the numeral 11 and a base portion generally indicated by the numeral 12. Cover 11 includes a top surface 13 which continues at its ends as downturned arcuate side surfaces 14, 15 and also includes arcuate front and rear surfaces 16 and 17, respectively. A skirt 18 is formed around the entire lower periphery of side surfaces 14, 15, front surface 16 and rear surface 17, and a peripheral lip 19 is spaced inwardly from skirt 18 to rest on the upper periphery of base 12 as will hereinafter be described. Rear surface 17 of cover 11 is pivotally attached to base portion 12 by a hinge mechanism generally indicated by the numeral 20, and a latch mechanism, generally indicated by the numeral 21 and carried by base portion 12, secures the front of cover 11 to the front of base 12 as will be hereinafter described in more detail.

Figure 2:
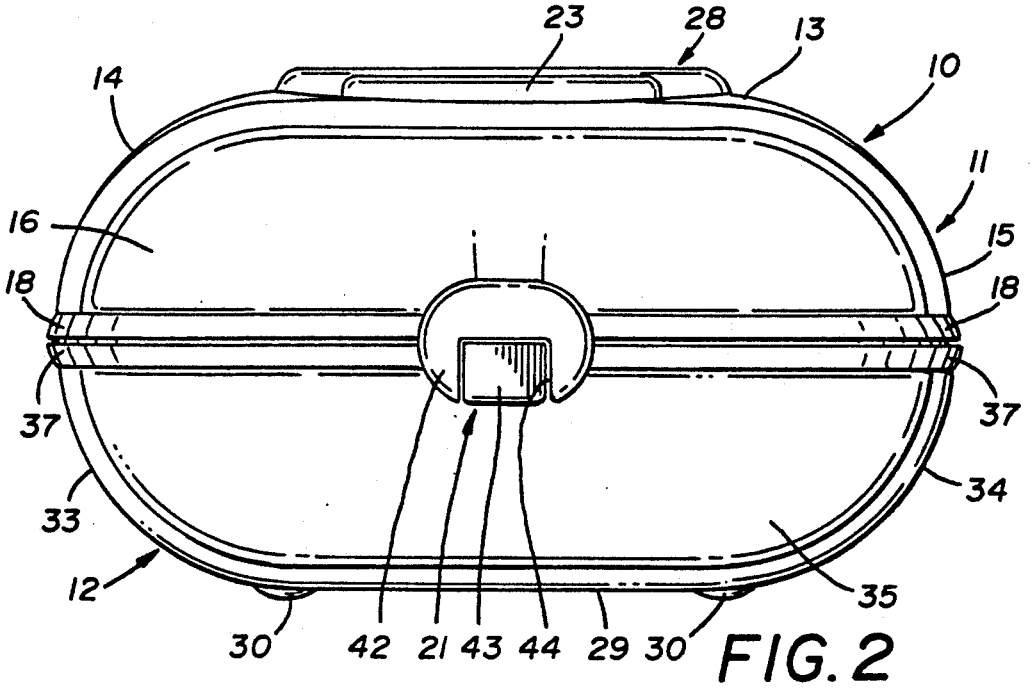
FIG. 2 is a front elevational view of the container of FIG. 1.
Figure 3:
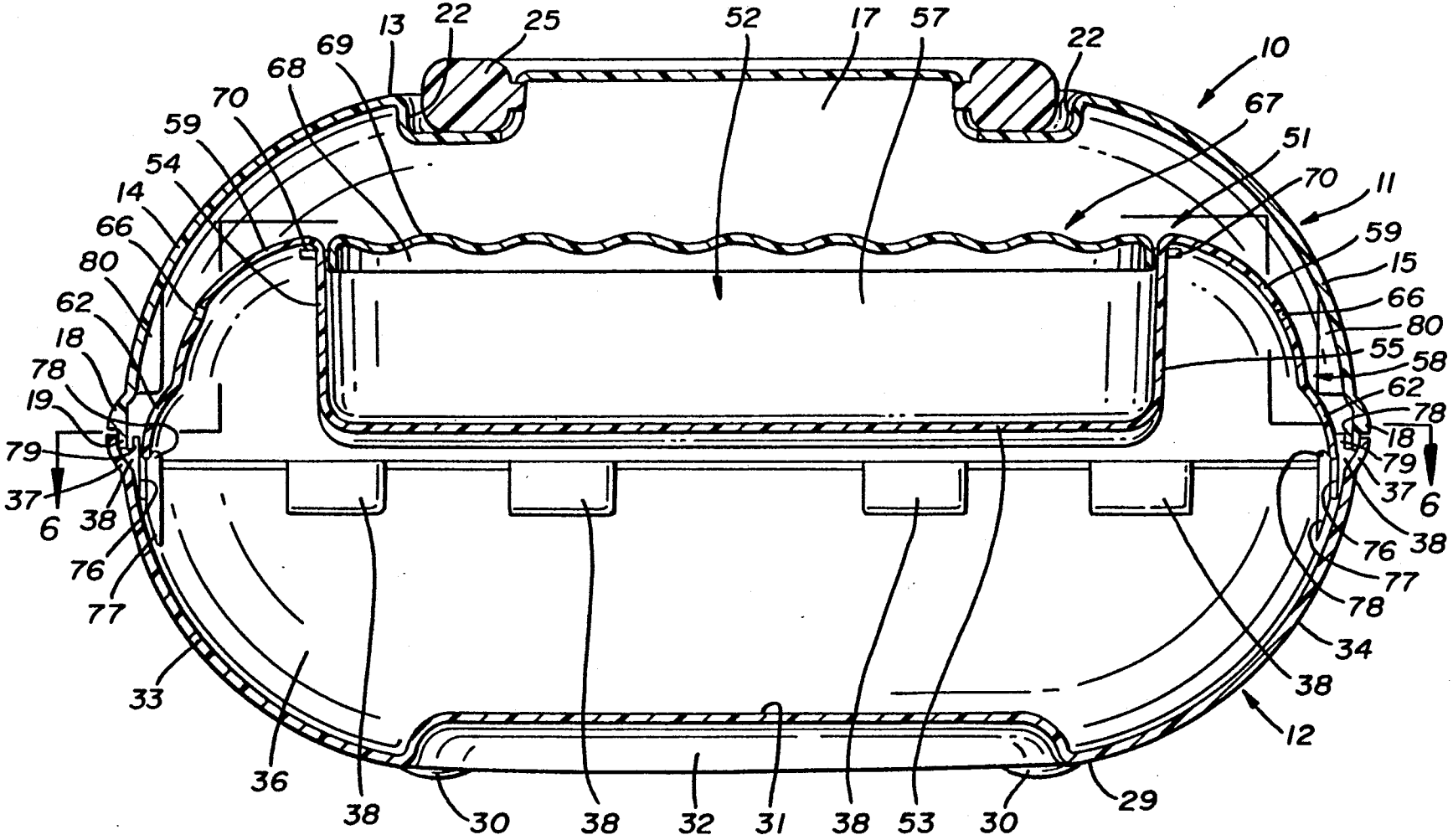
FIG. 3 is a sectional view taken substantially along line 3—3 of FIG. 1.
Figure 4:
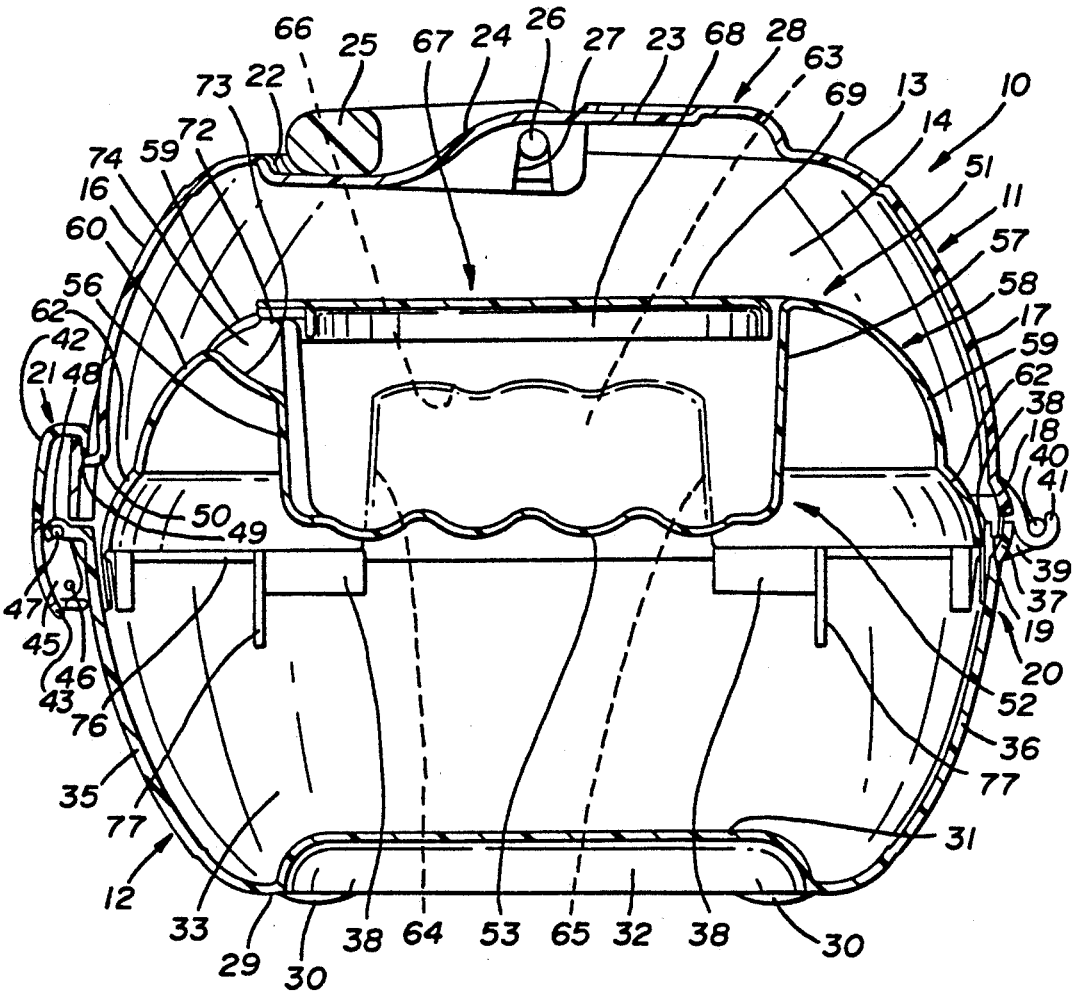
FIG. 4 is a sectional view taken substantially along line 4—4 of FIG. 1.

Top surface 13 is preferably provided with a U-shaped recess 22 generally defined by a central hub 23. As best shown in FIG. 4 near the rear of cover 11, hub 23 extends above top surface 13 and then slopes downwardly, as at 24, to form the bottom of recess 22. A handle 25 is provided with inwardly directed pins 26 at the lower extremities thereof which are received in a slot 27 in hub 23 so that handle 25 is pivotable with respect to hub 23 from an upright, carrying position to a stored position shown, for example in FIGS. 3 and 4. In the stored position, handle 25 is partially within recess 22 such that the upper edge of handle 25 in the stored position is generally coincident with the uppermost portion of hub 23. As such, and as best shown in FIG. 2, together, hub 23 and handle 25 form a locating lug 28 which, as will hereinafter be described, facilitates the nesting or stacking of one container 10 on another.

Base portion 12 includes a bottom surface 29 which is shown as having a plurality of small feet 30 formed therein and depending therefrom. A raised pedestal 31 forms a lower recess 32 in bottom surface 29, which recess is configured to complement the configuration of lug 28 of cover 11 so that, when like containers 10 are stacked or nested, lug 28 is received in recess 32 for a stable and convenient stacking of like containers which minimizes the potential lateral shifting thereof.

Bottom surface 29 continues at its ends as upturned arcuate side surfaces 33, 34 which complement the shape of cover side surfaces 14 and 15. Similarly, front surface 35 and rear surface 36 of base portion 12 extend upwardly from bottom surface 29 and complement front surface 16 and rear surface 17 of cover 11. Front surface 35 carries a portion of latch mechanism 21 and rear surface 36 carries a portion of hinge mechanism 20.

A skirt 37 is formed around the entire open upper periphery of base side surfaces 33 and 34, base front surface 35 and base rear surface 36 complementing skirt 18 on cover 11. A plurality of spaced shiplaps 38 are spaced inwardly from skirt 37 and the peripheral lip 19 of cover 11 is received between skirt 37 and shiplaps 38 when container 10 is in the closed condition.

Hinge mechanism 20 can be of any conventional type and as shown includes a plurality of flanges 39 which extend outward from rear surface 36 of base portion 12 and carry hinge pins 40 therebetween. Hinge pins 40 receive knuckles 41 which extend outwardly from rear surface 17 of cover portion 11. As such, as cover 11 is being opened or closed, knuckles 41 ride on pins 40 in the typical hinge-operating fashion.

Figure 5:
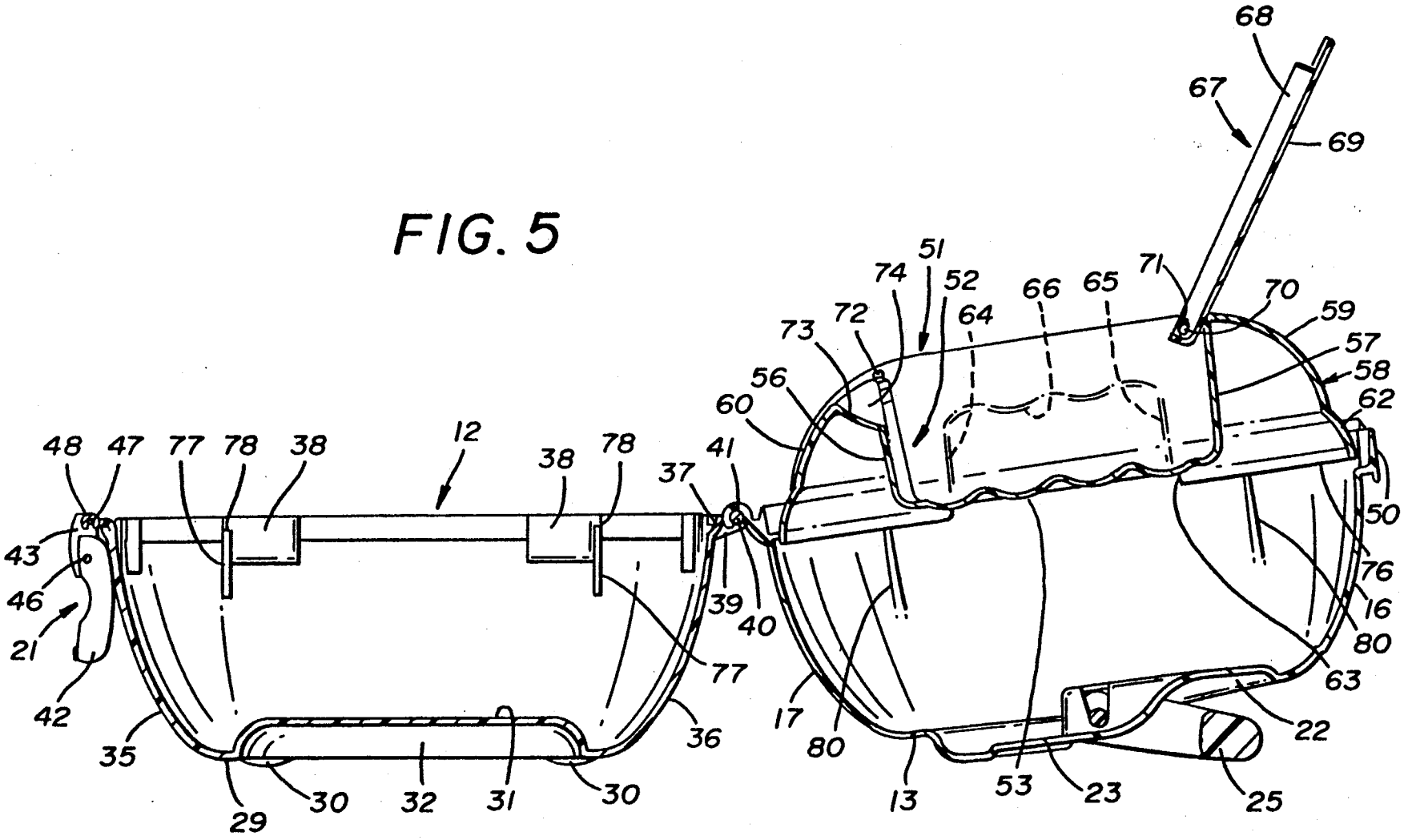
FIG. 5 is a partially sectioned elevational view showing the container in an open position with the tray being positioned in the cover portion of the container.

Latch mechanism 21 can likewise be of any conventional type but is shown, somewhat schematically in FIGS. 4 and 5, as being of the type commonly known as an over-the-center latch mechanism. As such, latch mechanism 21 includes a latch handle 42 and a link arm 43 connecting handle 42 to base portion 12. As shown for example in FIG. 2, link arm 43 is positioned within a generally U-shaped recess 44 formed in the lower portion of handle 42. As shown more schematically in FIG. 4, peripheral ribs 45 formed on link arm 43 receive pins 46 extending inwardly from the lower portion of handle 42 and into recess 44. Ribs 45 also carry another pin 47, positioned outwardly and above pins 46, pin 47 being received in a knuckle 48 extending outwardly from base portion front surface 35. The top of latch handle 42 is provided with a hook member 49 which is received in a locking lug 50 formed on front cover surface 16.

With latch mechanism 21 closed and holding cover 11 to base 12 by virtue of the fact that hook member 49 is engaging cover lug 50, as shown for example in FIGS. 2 and 4, latch mechanism 21 may be released by first lifting link arm 43 pivoting the same on pin 47. Such movement swings pins 47 to the left in FIG. 4 to pass the pivot point defined by pin 47 thereby loosening hook member 49 from lug 50. Once loosened, hook member 49 may be disengaged from lug 50 by slightly lifting latch handle 42, and both handle 42 and link arm 43 may be pivoted on pin 46 to the fully open position as shown, for example, in FIG. 5. Of course, to reengage latch mechanism 21, handle 42 and link arm 43 may be pivoted upwardly on pin 46, hook member 49 inserted into lug 50, and link arm 43 pivoted on pin 47 back to the FIG. 4 position to draw hook member 49 into engagement with lug 50.

A tray, generally indicated by the numeral 51, is selectively positioned within container 10 as detailed hereinbelow. Tray 51 is preferably molded from the same polypropylene material as container 10 and includes a basket portion generally indicated by the numeral 52. Basket 52 includes an undulating, generally rectangular bottom surface 53 with side walls 54, 55 and front and back walls 56, 57, respectively, extending upwardly from the peripheral edges thereof. A support wall, generally indicated by the numeral 58, surrounds basket 52 and provides the means necessary to support tray 51 in container 10 or elsewhere.

Figure 6:
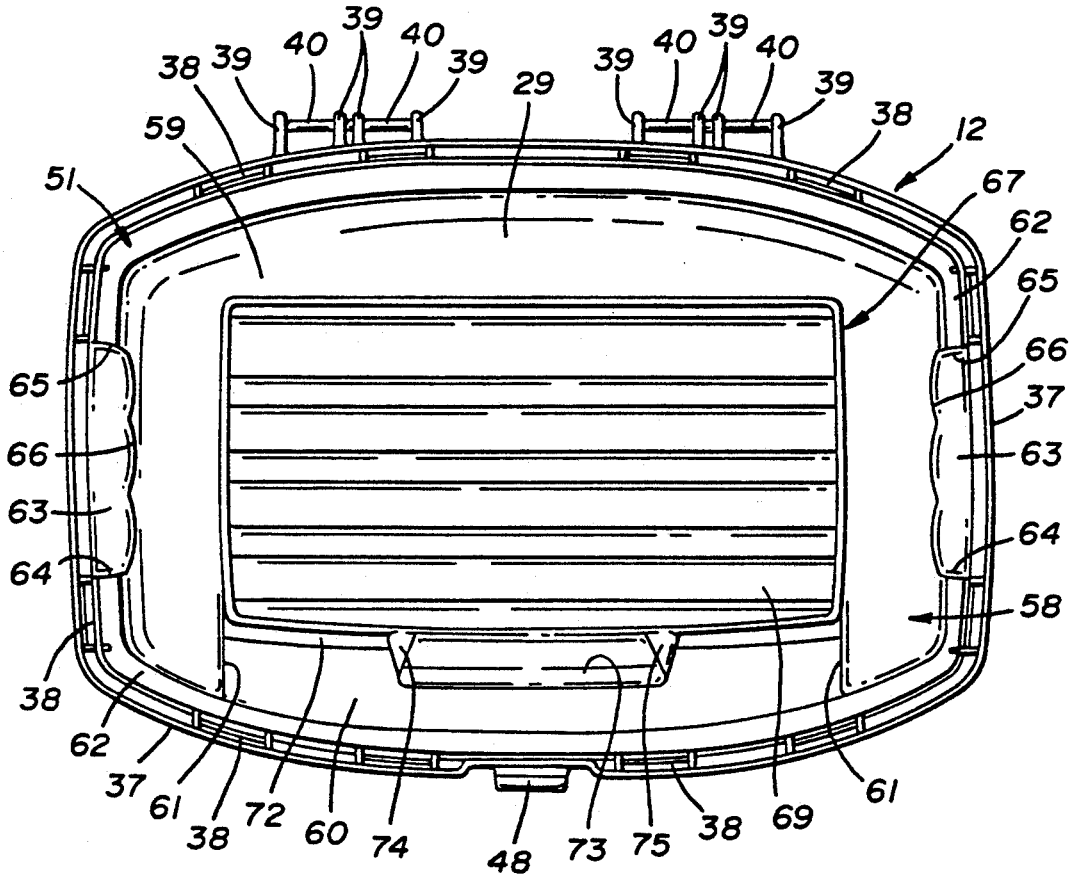
FIG. 6 is a sectional view taken substantially along line 6—6 of FIG. 5.

More particularly, support wall 58 includes a generally arcuate first upper wall 59 which extends outwardly and downwardly from the upper edges of each side wall 54, 55 and back wall 57. Likewise, a generally arcuate second upper wall 60 extends outwardly and downwardly from the upper edge of front wall 56. However, because front wall 56 is generally shorter than the rest of the walls of basket 52 to accommodate a mirror, as detailed hereinbelow, the top of second upper wall 60 is slightly lower than first upper wall 59. Accordingly, at least a portion of side walls 54, 55 extend beyond front wall 56, as at 61 (FIG. 6). A peripheral skirt 62 extends further outwardly and downwardly from the lower end of arcuate first and second upper walls 59 and 60 and terminates below the level of the plane of bottom surface 53 of basket 52. At both sides of tray 51, skirt 62 and a portion of first upper wall 59 are interrupted by voids 63 defined between edges 64 and 65. The lower termination edge 66 of first upper wall 59 is preferably of an undulated design similar to that of bottom surface 53 of basket 52 and provides a gripping surface for lifting tray 51 out of container 10 when the user positions his hands or fingers within voids 63.

Tray 51 may further include a generally rectangular mirror assembly generally indicated by the numeral 67 which also acts as a lid for tray 51. Mirror assembly 67 includes the conventional reflective front mirror surface 68 and an undulating back wall 69. Extending from the side edges of mirror assembly 67, near the lower corners thereof, are pivot pins 70 received by notches 71 in side walls 54 and 55 of tray 51. These pivot pins 70 permit mirror assembly 67 to be rotated from its closed position shown in FIGS. 3 and 4 to its open position shown in FIG. 5. It will be appreciated that any hinge mechanism commonly used in the art may be used in place of pivot pins 70.

As shown in FIG. 4, undulating back wall 69 extends past the opening in tray 51 defined by basket 52, such that in the closed position, the low points of the undulating back wall 69 contact a lug 72 carried at the top of second upper wall 60. Lug 72 is interrupted generally centrally of the second upper wall 60 by a recess 73 defined between opposed walls 74 and 75 in second upper wall 60 to provide access to the top of mirror assembly 67 so that it may be lifted and opened. In its closed position, mirror assembly 67 lies flat such that it is in general alignment with the top surface of first upper wall 59.

It will be appreciated that tray 51 rests on a lower edge surface 76 of support wall 58 rather than on bottom surface 53 of basket 52. Inasmuch as the lower edge surface 76 lies in one plane, tray 51 maintains stability and is free-standing outside of container 10. However, if desired, tray 51 may be selectively positioned within either base 12 or cover 11 of container 10.

To this end, base 12 includes a plurality of inwardly directed ribs 77 generally disposed on the inside of side surfaces 33 and 34. Additional ribs (not shown) may be disposed on the inside of front and rear surfaces 35 and 36, respectively, if desired. Each rib 77 includes a knob 78 on the top inward portion thereof so as to present a notch 79 between knob 78 and an adjacent shiplap 38. Accordingly, terminating edge surface 76 of support wall 58 of tray 51 may be selectively positioned in base 12 at each notch 79 so as to secure tray 51 within container 10.

When container 10 is open, a similar rib 80 is formed to extend inwardly from cover side surfaces 14 and 15. However, in the preferred embodiment, ribs 80 do not include a knob similar to that disposed upon ribs 77. Consequently, tray 51 may be selectively positioned within cover 11 by contacting terminating edge surface 76 of support wall 58 with the flat top edge of each rib 80 as shown in FIG. 5.

Thus, it should be evident that the container of the present invention enables the user to position the tray in the base or the cover of the container, or to place it elsewhere, as on a countertop, as may be desired by the user. The mirror is attached to the tray so as to provide a convenient storage space for the mirror as well as permit easy access thereto. The invention is particularly suited for cosmetics and jewelry items, but is not necessarily limited thereto.

It should thus be apparent that a container constructed according to the concepts of the present invention as described herein accomplishes the objects of the present invention and otherwise substantially improves the container art.

I claim:

1. A container for holding items comprising a base portion, a cover portion hingedly attached to said base portion at one end and selectively attached to said base portion at the opposite end, a tray positionable in the container and including a basket portion having a bottom surface and upturned side walls, said tray also including a peripheral support portion extending generally outwardly and downwardly from the upper edges of said upturned side walls, first rib means extending inwardly from said base portion to selectively support said tray, and a second rib means extending inwardly from said cover portion to selectively support said tray when the container is open.

2. A container according to claim 1, wherein said tray is freestanding and can be separately removed from the container.

3. A container according to claim 1, wherein said tray further includes a mirror assembly hingedly attached thereto, said mirror assembly generally forming a lid for said tray.

4. A container according to claim 3, wherein said mirror assembly and said tray are generally rectangular, said mirror assembly being hingedly attached to said tray at the rear corners thereof near the upper edges of opposed of said side walls.

5. A container according to claim 3, wherein said mirror assembly includes a reflective front surface and an undulating back wall.

6. The container according to claim 1, wherein said tray further includes handle means for assisting in the removal of said tray from the container.

7. A container according to claim 1, further comprising handle means on said cover portion for carrying the container.

8. A container according to claim 1, further comprising a hinge mechanism at one end of the container for hingedly attaching said cover portion to said base portion and a latch mechanism at an opposite end of the container for selectively attaching said cover portion to said base portion.

9. A container according to claim 8, wherein said latch mechanism includes a latch handle terminating at its upper end with a hook member and a link arm operatively connected at its lower end to the lower end of said latch handle and operatively connected at its upper end to said base portion, said hook member operatively engaging said cover portion.

10. In combination, a container and a tray for holding items, said container having a base portion and a cover portion operatively attached thereto, first rib means in said base portion for supporting said tray, and second rib means in said cover portion for also supporting said tray, whereby said tray is selectively positionable on said first or second rib means, and said tray including a basket portion having a bottom surface and upturned side walls, and a peripheral support portion extending generally outwardly and downwardly from the upper edges of said upturned side walls.

11. The combination according to claim 10, wherein said tray is free-standing and can be outside said container.

12. The combination according to claim 10, wherein said tray further includes a mirror assembly hingedly attached thereto, said mirror assembly generally forming a lid for said tray.

13. The combination according to claim 12, said mirror assembly and said tray are generally rectangular, said mirror assembly being hingedly attached to said tray at the rear corners thereof near the upper edges of opposed of said side walls.

14. The combination according to claim 12, wherein said mirror assembly includes a reflective front surface and an undulating back wall.

15. The combination according to claim 10, wherein said tray further includes handle means for assisting in the removal of said tray from the container.

16. The combination according to claim 10, wherein said container further comprising handle means on said cover portion for carrying the container.

17. The combination according to claim 10, wherein said cover portion is operatively attached to said base portion by at least one hinge mechanism located at one end of said container and at least one latch mechanism located at the opposite end of said container.

* * * * *